US008734541B2

(12) United States Patent
Felix-Moore et al.

(10) Patent No.: US 8,734,541 B2
(45) Date of Patent: May 27, 2014

(54) DIESEL FUEL FORMULATION

(75) Inventors: Allison Felix-Moore, Chester (GB); George Robert Lee, Chester (GB); Richard John Price, Chester (GB)

(73) Assignee: Shell Oil Company, Houston, TX (US)

( * ) Notice: Subject to any disclaimer, the term of this patent is extended or adjusted under 35 U.S.C. 154(b) by 30 days.

(21) Appl. No.: 13/164,361

(22) Filed: Jun. 20, 2011

(65) Prior Publication Data

US 2012/0145106 A1 Jun. 14, 2012

(30) Foreign Application Priority Data

Jun. 22, 2010 (EP) ..... 10166838

(51) Int. Cl.
*C10L 1/18* (2006.01)

(52) U.S. Cl.
USPC ..... 44/388; 44/447

(58) Field of Classification Search
USPC ..... 44/388, 447
See application file for complete search history.

(56) References Cited

U.S. PATENT DOCUMENTS

| | | | | |
|---|---|---|---|---|
| 5,308,365 | A | 5/1994 | Kesling, Jr. et al. | 44/447 |
| 5,387,720 | A | 2/1995 | Neher et al. | 568/486 |
| 5,578,090 | A | 11/1996 | Bradin | |
| 5,892,129 | A | 4/1999 | Hoepp et al. | 568/600 |
| 6,015,440 | A | 1/2000 | Noureddini | 44/388 |
| 6,113,661 | A * | 9/2000 | Germanaud et al. | 44/444 |
| 2007/0260078 | A1 | 11/2007 | Bhat et al. | |
| 2008/0167503 | A1 | 7/2008 | Yusof et al. | 568/698 |
| 2008/0293602 | A1 | 11/2008 | Kodali | 508/463 |

FOREIGN PATENT DOCUMENTS

| | | | |
|---|---|---|---|
| FR | 1447138 | 7/1966 | |
| GB | 2368594 | 5/2002 | C10L 1/18 |
| WO | WO9856879 | 12/1998 | C10L 1/02 |
| WO | WO2005093015 | 10/2005 | C10L 1/02 |
| WO | WO2007061903 | 5/2007 | C10L 1/182 |
| WO | WO2008112910 | 9/2008 | C10L 1/18 |
| WO | WO2009141564 | 11/2009 | C10L 1/18 |

OTHER PUBLICATIONS www.americanpalmoil.com/biodiesel.html 2003.*

Pavel Afanasiev, "Synthetic Approaches to the Molybdenum Sulfide Materials," C. R. Chimie 11 (2008) pp. 159-182.

Debao Li et al., "Ni/ADM: a high activity and selectivity to $C_2$ + OH catalyst for catalytic conversion of synthesis gas to $C_1$-$C_5$ mixed alcohols," *Topics in Catalysis*, vol. 32, Nos. 3-4, Mar. 2005 pp. 233-239.

Melero, et al.; "Oxygenated compounds derived from glycerol for biodiesel formation, influence on EN 14214 quality parameters"; Fuel, vol. 89; pp. 2011-2018; Apr. 8, 2010.

European Search Report; Application No. 10166838.2; 6 pages; Dec. 2, 2010.

* cited by examiner

*Primary Examiner* — Cephia D Toomer

(57) ABSTRACT

A diesel fuel formulation containing a triethoxypropane and a palm oil methyl ester (POME), and a diesel fuel supplement containing a premix of a triethoxypropane and a POME is disclosed. The triethoxypropane may be 1,2,3-triethoxypropane or 1,1,3-triethoxypropane.

11 Claims, No Drawings

DIESEL FUEL FORMULATION

TECHNICAL FIELD OF THE INVENTION

This invention relates to diesel fuel formulations, their preparation and their use.

BACKGROUND OF THE INVENTION

In the interests of the environment, and to comply with increasingly stringent regulatory demands, it is necessary to increase the amount of biofuels used in automotive fuels.

Biofuels are combustible fuels, typically derived from biological sources, which result in a reduction in "well-to-wheels" (ie from source to combustion) greenhouse gas emissions. In diesel fuels for use in compression ignition engines, the most common biofuels are fatty acid alkyl esters (FAAEs), in particular fatty acid methyl esters (FAMEs) such as rapeseed methyl ester and palm oil methyl ester; these are used in blends with conventional diesel fuel components.

There can however be drawbacks associated with the use of FAMEs in diesel fuels, in particular at higher concentrations. The addition of a FAME to a diesel fuel raises its cloud point, to an extent dependent on the FAME concentration, and also raises the cold filter plugging point (CFPP) of the fuel This can compromise the performance of the fuel, both during handling in the fuel distribution system and on-board vehicles.

FAMEs and their oxidation products also tend to accumulate in engine oil, leading to changes in the properties of the lubricant and a number of related issues. FAMEs have also been associated with deposit-related and oxidation stability issues. This has limited their use in modern FAME/diesel blends, typically to below around 10% v/v. At higher concentrations FAMEs can also cause fouling of fuel injectors.

Moreover, due to the incomplete esterification of oils (triglycerides) during their manufacture, FAMEs can contain trace amounts of glycerides, in particular monoglycerides. These glycerides tend, on cooling, to crystallise out before the FAMEs themselves, and can cause fuel filter blockages. This too can compromise the cold weather operability of a FAME-containing diesel fuel.

The most common monoglycerides present in FAMEs are the saturated C16:0 (palmitic) and C18:0 (stearic) monoglycerides, and the unsaturated C18:1 (oleic) and C18:2 (linoleic) monoglycerides. The amount of each of these which is present in a FAME will depend on the nature of the FAME and also on the process by which it was manufactured. It is the saturated monoglycerides which appear to have the most detrimental effect on cold weather performance of FAME-containing fuels, since they are less soluble than for instance triglycerides and more prone to precipitate at low temperatures; they are also typically present at higher levels than triglycerides (the European specification EN 14214:2003 for FAMEs for use as diesel fuels allows 0.8% w/w of monoglycerides but only 0.2% w/w of triglycerides). Certain monoglycerides are also thought to be responsible for corrosion and injector fouling issues in fuels containing FAMEs.

These factors together mean that it can be difficult to formulate diesel fuel/FAME blends within the relevant regulatory specifications, particularly in colder climates where specifications require maximum cloud points and CFPPs to be lower than in more temperate regions. As a result, FAMEs are typically included in diesel fuels, in particular winter grade fuels, at relatively low concentrations. Moreover FAMEs for use in diesel fuels need to be prepared to relatively stringent specifications as regards their glyceride contents, thus increasing the cost of their production. FAMEs for use in current diesel fuels are typically required to contain a maximum of 0.8% w/w monoglycerides (EN 14214).

In addition to fuel formulation constraints, their poor low temperature behaviour can make the neat FAMEs themselves difficult to handle and to transport in colder climates. In particularly severe conditions, heated supply lines may be needed in order to transport and handle the materials, and in some situations this makes certain FAMEs impractical, or at least unattractive, to work with at all.

It would be desirable to provide new biofuel-containing diesel fuel formulations which could overcome or at least mitigate the above problems.

A number of alternative biofuel components have accordingly been investigated, amongst which are the glycerol ethers. Since glycerol is a byproduct of the transesterification of oils to produce FAMEs, it is available in increasing abundance as the demand for higher biofuel contents increases. It can accordingly provide a commercially attractive starting material from which to generate further biofuels: it can for example be reacted with methanol or ethanol to yield, respectively, methoxy- or ethoxypropane ethers.

Several published documents describe the synthesis of glycerol ethers and their use in diesel fuel formulations, for example US-A-2008/0293602 (glycerol monoethers, and also 1,2,3-trimethoxypropane); US-A-2008/0167503 (tertiary alkoxypropane ethers such as those formed from t-butanol); and WO-A-2005/093015 (mixtures of mono-, di- and trialkoxy ethers of glycerol, in particular t-butyl ethers).

Glycerol ethers tend to have better low temperature properties than FAMEs (for example lower cloud points, pour points and CFPPs). U.S. Pat. No. 6,015,440 teaches that they can be used to reduce the viscosities and the cloud points of diesel fuels. WO-A-2008/112910 states that they can improve the viscosity and the low temperature properties of biodiesel fuel components such as FAMEs, implying a preference for C4-C5 alkoxy ethers such as those formed from t-butanol or isobutanol.

Other documents have suggested the use of glycerol ethers in diesel fuels as lubricants (US-A-2008/0293602), as cetane improvers and to reduce emissions. GB-A-2 368 594 for example discloses the use of 50% w/w or more of trialkoxyalkanes—including triethoxyalkanes and 1,1,3-trialkoxyalkanes—to reduce soot (particulate) emissions from diesel fuels. WO-A-98/56879 discloses the use of relatively low levels of an alkoxyalkane, in particular a 1,1,3-trialkoxypropane such as 1,1,3-triethoxypropane, to increase the cetane number of a diesel fuel. WO-A-2007/061903 suggests that partially etherified glycerol derivatives, in combination with alcohols, can lower NOx and particulate emissions from a diesel fuel, as well as improving its cetane value and lowering its viscosity.

U.S. Pat. No. 5,308,365 describes the use of di- and trialkoxypropane ethers in diesel fuels in order to reduce particulate emissions. A preference is expressed for C4-C5 alkoxy ethers, in particular t-butyloxy ethers. The trialkoxy ethers mentioned include 1,2,3-trialkoxy ethers.

WO-A-2009/141564 describes a process for the simultaneous production of FAAEs and glycerol ethers, using ethanol to convert the glycerol byproduct of the FAAE production into a mixture of ethoxy ethers. The document makes clear that the mono- and di-ethoxy ethers are the preferred products, and the process is ideally allowed to continue only until a suitable mixture of those products has been formed. This mixture, together with the FAAE generated at the same time, may then be incorporated into a diesel fuel.

SUMMARY OF THE INVENTION

According to one embodiment of the invention there is provided a diesel fuel formulation or supplement containing (i) a triethoxypropane and (ii) a palm oil methyl ester (POME). The formulation can optionally also contain (iii) an additional diesel fuel component, for example a diesel base fuel.

In another embodiment of the invention a process for preparing such a diesel fuel formulation or supplement is provided.

DETAILED DESCRIPTION OF THE INVENTION

It has now been found that certain specific glycerol ethers can provide particularly good, and hitherto unrecognised, improvements in the low temperature properties of the FAME palm oil methyl ester (POME). This allows the production of new and improved biofuel-containing diesel fuels, in which the glycerol ethers are combined with POME in order to reduce some of the detrimental effects which are normally associated with FAMEs.

Triethoxypropanes have been found to stabilise glycerides—in particular monoglycerides and more particularly saturated monoglycerides—which are present in POMEs or in diesel fuel formulations containing POMEs. The ethers appear to increase the solubility of the glycerides in the POME or the fuel formulation, thus reducing their tendency to crystallise out at low temperatures. This in turn can lower the cold filter plugging point (CFPP) of the POME or formulation and improve its performance and its storage and handling characteristics at lower temperatures.

The present invention can thus make possible the use of POMEs containing higher concentrations of glycerides, which are likely to be cheaper and more energy-efficient to produce, without unduly compromising the cold weather performance of the POMEs or of diesel fuel formulations containing them. The invention can allow the use of a wider range of POMEs in diesel fuel formulations, and/or the use of higher concentrations of POME than would otherwise have been feasible. The inclusion of the glycerol ether can also help to bring a POME-containing diesel fuel within specification as regards its CFPP and/or its general cold weather performance; this can be of particular value where the fuel is for use in a colder climate. Thus the present invention is able to provide more optimised methods for formulating biofuel-containing diesel fuel formulations, in particular winter grade diesel fuels.

Because of its ability to solubilise glycerides in diesel fuels, a triethoxypropane may also be added to a POME-containing diesel fuel formulation in order to resolubilise already-formed glyceride precipitates, and hence at least partially to restore the previous cold weather performance of the formulation. In other words, a triethoxypropane may be used not only to help prevent, but also in cases to reverse, glyceride crystallisation in a POME-containing diesel fuel formulation.

The incorporation of a triethoxypropane into a diesel fuel formulation can provide the advantages which have previously been associated with glycerol ether-containing fuels. It can for example increase the cetane number of the formulation, reduce its viscosity and/or improve its low temperature performance. It can reduce emissions levels. The flash points and distillation properties of triethoxypropanes also make them suitable for splash blending with other diesel fuel components, and the resulting formulations can be distributed via existing systems, without the need for additional handling precautions.

Moreover the inclusion of a triethoxypropane in a diesel fuel formulation can increase the biofuel content of the formulation, without the above described disadvantages (for example, detrimental effects on engine oils, and on cold flow properties) that would be associated with the inclusion of the same concentration of a FAME.

There can also be environmental and commercial benefits to using glycerol ethers in diesel fuels. It ensures that following the production of FAME biofuels from for example vegetable oils, all of the oil (including the glycerol byproduct) can be used as biofuel. This also helps to address the surplus of glycerol which arises from increased FAME production. The environmental benefits can be increased by producing the triethoxypropane using biologically derived ethanol, as described in more detail below.

In the invented formulation, the triethoxypropane may be selected from 1,2,3-triethoxypropane; 1,1,3-triethoxypropane; and mixtures thereof. In an embodiment, it is 1,2,3-triethoxypropane. In an embodiment, it is 1,1,3-triethoxypropane.

The triethoxypropane may be produced via known synthetic routes, for example by a condensation reaction between glycerol, or a derivative thereof, and ethanol. The ethanol may be biologically derived, by which is meant that it has been obtained—whether directly or indirectly—from a biological source, for example a sugar, starch or cellulose. In this way, the triethoxypropane may be a totally biologically derived product, which can make it a particularly attractive diesel fuel additive for environmental, regulatory and/or economic reasons.

In an embodiment, the glycerol which is used as a starting material in the production of the triethoxypropane is itself a product of the transesterification of an oil such as an animal or in particular vegetable oil to produce a FAAE, for example a FAME. The glycerol may be purified, at least to an extent, following the transesterification, or it may be a crude product. In an alternative embodiment, the glycerol may be obtained as a byproduct of the fermentation of a sugar.

The glycerol derivative may be acrolein, which can be reacted with ethanol to prepare 1,1,3-triethoxypropane. Thus, in an embodiment of the invention, the fuel formulation contains 1,1,3-triethoxypropane which has been produced by converting glycerol to acrolein and then reacting the acrolein with ethanol. The glycerol may be converted to acrolein by known methods, for example by heating to between 270 and 320° C. The advantage of this synthetic route is that it can yield 1,1,3-triethoxypropane as a single product: this too can make 1,1,3-triethoxypropane a more attractive diesel fuel component than the glycerol ethers used in much of the prior art, which were typically produced by reacting glycerol with alcohols to yield a mixture of products such as mono-, di- and trialkoxypropanes as well as self-condensed diglycerol ethers.

Methods for converting glycerol to a 1,1,3-trialkoxypropane via acrolein are described for instance in U.S. Pat. No. 5,387,720 and U.S. Pat. No. 5,892,129 which disclosures are herein incorporated by reference.

The concentration of the triethoxypropane, in a formulation according to the invention, may be 1% v/v or greater. It may for example be 2 or 2.5 or 3 or 4% v/v or greater, or in cases 5 or 6 or 7 or 8 or 9 or 10% v/v or greater. The concentration of the triethoxypropane may be up to 20% v/v, or up to 18 or 15 or 12% v/v, or up to 10% v/v.

Palm oil usually contains a mixture of palmitic, stearic and linoleic acid components, the relative proportions of which may vary depending on its source; in POME these will be present as the corresponding methyl esters, often together with small amounts of the free fatty acids, glycerol and other impurities such as mono- and diglycerides. For use in the present invention, a POME may be derived from any suitable source.

The POME suitably—although this is not essential—conforms to the European specification EN 14214 for fatty acid methyl esters for use as diesel fuels. It may have a flash point (IP 34) of greater than 101° C.; a measured cetane number (ASTM D613) of 55 or greater, or of 58 or 60 or 65 or even 70 or greater; a kinematic viscosity at 40° C. (IP 71 or EN ISO 3104) of from 1.9 to 6.0 centistokes, or from 3.5 to 5.0 centistokes; a density from 845 to 910 kg/m$^3$, or from 860 to 900 kg/m$^3$, at 15° C. (IP 365, EN ISO 12185 or EN ISO 3675); a water content (IP 386) of less than 500 ppm; a T95 (the temperature at which 95% of the fuel has evaporated, measured according to IP 123 or EN ISO 3405) of less than 360° C.; an acid number (IP 139) of less than 0.8 mgKOH/g, or of less than 0.5 mgKOH/g; and/or an iodine number (IP 84) of less than 125, or of less than 120 or less than 115, grams of iodine ($I_2$) per 100 g of fuel. It may also contain (eg by NMR) less than 0.2% w/w of free alcohol, less than 0.02% w/w of free glycerol and/or greater than 96.5% w/w esters.

The concentration of the POME, in a diesel fuel formulation according to the invention, may be 0.5% v/v or greater, or 1 or 2 or 2.5 or 3 or 4% v/v or greater, or in cases 5 or 6 or 7 or 8 or 9 or 10% v/v or greater. Its concentration may be up to 30% v/v, or up to 25 or 20 or 15 or 10% v/v, or in cases up to 9 or 8 or 7% v/v.

The volume ratio of the triethoxypropane to the POME in the formulation may for instance be 1:25 or greater, or 1:10 or 1:5 or 1:2 or 1:1 or greater. The ratio may be up to 5:1, or up to 2:1 or up to 1:1. It may for example be from 2:1 to 1:2, or from 2:1 to 1:1. It may be 1:1 or approximately 1:1.

In addition to the triethoxypropane and the POME, a diesel fuel formulation according to the invention may contain one or more additional diesel fuel components (iii), in particular one or more diesel base fuels. An additional diesel fuel component may be any fuel component suitable for combustion within a compression ignition (preferably diesel) engine. It will preferably be a liquid hydrocarbon middle distillate fuel, for example a gas oil. It may be or contain a kerosene fuel component. It may be petroleum derived. Alternatively it may be synthetic: for instance it may be the product of a Fischer-Tropsch condensation. It may be or include a biofuel component, which has been derived—whether directly or indirectly—from a biological source. It may be or include an oxygenate such as an additional FAAE, in particular a FAME such as rapeseed methyl ester (RME) or soya methyl ester (SME).

A diesel fuel component (iii) will suitably boil in the range from 150 or 180 to 360 or 370° C. (ASTM D86 or EN ISO 3405). It will suitably have a measured cetane number (ASTM D613) of from 40 to 70 or from 40 to 65 or from 51 to 65 or 70.

The concentration of the one or more additional diesel fuel components (iii), in a formulation according to the invention, may be 70% v/v or greater. It may for example be 75 or 80 or 85% v/v or greater, or in cases 90 or 92 or 95% v/v or greater. The concentration of the one or more additional diesel fuel components may be up to 99% v/v, or up to 98% v/v, or up to 95 or 92 or 90% v/v, or in cases up to 85 or 80% v/v. The additional diesel fuel component(s) (for example diesel base fuel(s)) may represent the major proportion of a fuel formulation according to the invention. After inclusion of the triethoxypropane (i), the POME (ii) and any optional fuel additives, the component(s) (iii) may represent the balance to 100%.

A diesel fuel formulation according to the invention will suitably comply with applicable current standard diesel fuel specification(s) such as for example EN 590 (for Europe) or ASTM D975 (for the USA). By way of example, the overall formulation may have a density from 820 to 845 kg/m$^3$ at 15° C. (ASTM D4052 or EN ISO 3675); a T95 boiling point (ASTM D86 or EN ISO 3405) of 360° C. or less; a measured cetane number (ASTM D613) of 51 or greater; a kinematic viscosity at 40° C. (ASTM D445 or EN ISO 3104) from 2 to 4.5 centistokes; a sulphur content (ASTM D2622 or EN ISO 20846) of 50 mg/kg or less; and/or a polycyclic aromatic hydrocarbons (PAH) content (IP 391(mod)) of less than 11% w/w. Relevant specifications may however differ from country to country and from year to year, and may depend on the intended use of the formulation. Moreover a formulation according to the invention may contain individual fuel components with properties outside of these ranges, since the properties of an overall blend may differ, often significantly, from those of its individual constituents.

A fuel formulation according to the invention suitably has a CFPP (IP 309 or EN 116) of 5° C. or lower, or of 0° C. or lower, or of −5 or −10° C. or lower. It may have a CFPP of −15° C. or lower, or of −18° C. or lower, or of −20 or −25 or −30 or −35 or −44° C. or lower. It suitably has a cloud point (ASTM D5773) of 0° C. or lower, or of −5 or −10° C. or lower, or of −12 or −15 or −20 or −25 or −30° C. or lower. It suitably has a flash point (ASTM D92 or D93) of 40° C. or higher, or of 45 or 50 or 55° C. or higher.

The formulation should be suitable and/or adapted for use in a compression ignition, in particular diesel, internal combustion engine. Such an engine may be either heavy or light duty. The formulation may in particular be suitable for use as an automotive diesel fuel.

In an embodiment, the formulation is suitable and/or adapted for use as a "winter grade" automotive diesel fuel, for use in colder climates such as in northern Europe (particularly Scandinavia) or North America. It may be a so-called "arctic grade" fuel, for use in particularly extreme climates such as in northern Scandinavia.

In further embodiments the formulation may be suitable and/or adapted for use as an industrial gas oil, or as a domestic heating oil.

A fuel formulation according to the invention may contain one or more standard fuel or refinery additives, in particular additives which are suitable for use in automotive diesel fuels. Many such additives are known and commercially available. The formulation may for example contain one or more additives selected from cetane improvers, antistatic additives, lubricity additives, cold flow additives, antioxidants and mixtures thereof. Such additives may be added at any point during the preparation of the formulation, including as a premix with one or more other components of the formulation. They may be included at a concentration of up to 300 ppmw, for example of from 50 to 300 ppmw, based on the overall formulation.

According to another aspect of the present invention, there is provided a diesel fuel supplement for use in a diesel fuel formulation, the supplement containing (i) a triethoxypropane and (ii) a POME. Thus, the POME may be premixed with the glycerol ether and then added to one or more diesel fuel components, such as a component (iii) of the type described above, in order to prepare a diesel fuel formulation. Premixing the POME with the triethoxypropane can, by stabilising the glycerides present in the POME, help to improve its handling and storage properties, in particular at low temperatures.

The volume ratio of the triethoxypropane to the POME in the supplement may be 1:25 or greater, or 1:10 or greater, or 1:5 or 1:2 or 1:1.5 or 1:1 or greater. The ratio may be up to 5:1, or up to 2:1 or 1.5:1, or up to 1:1. It may for example be from 2:1 to 1:2, or from 2:1 to 1:1. It may be 1:1 or approximately 1:1.

The supplement may for example be used in a diesel fuel formulation at a concentration of 0.5% v/v or greater, or of 1 or 2% v/v or greater, or of 3 or 4 or 5% v/v or greater, or in cases of 6 or 8 or 10 or 12 or even 15% v/v or greater. It may be used at a concentration of up to 30% v/v, or of up to 25 or 20 or 18 or 15% v/v, or in cases of up to 12 or 10 or 8% v/v.

According to another aspect of the invention, there is provided a process for the preparation of a diesel fuel formulation or a diesel fuel supplement, which process involves blending together (i) a triethoxypropane, (ii) a POME and optionally (iii) one or more additional diesel fuel components. One or more fuel additives may also be blended with components (i), (ii) and if appropriate (iii). The process may be used to produce at least 1,000 liters of a fuel formulation, or at least 5,000 or 10,000 or 20,000 or 25,000 liters, or at least 50,000 or 75,000 or 100,000 liters. It may be used to produce at least 20 liters of a fuel supplement, or at least 50 or 100 or 200 or 400 liters, or at least 500 or 1,000 or 2,000 liters.

In an embodiment of the third aspect of the invention, the triethoxypropane is 1,1,3-triethoxypropane and the process involves firstly preparing the 1,1,3-triethoxypropane by converting glycerol to acrolein and then reacting the acrolein with ethanol.

In an embodiment, the process is used to prepare a diesel fuel formulation. The triethoxypropane and the POME are premixed in an appropriate volume ratio, and the mixture then blended with the additional fuel component(s) (iii). The triethoxypropane/POME mixture may be blended with the component(s) (iii) at the concentrations described above in connection with the first or second aspect of the invention. Thus, the process of the third aspect of the invention may involve blending the one or more additional diesel fuel components (iii) with a diesel fuel supplement according to the second aspect.

Another aspect of the invention provides a method of operating an internal combustion engine, and/or a vehicle which is driven by an internal combustion engine, which method involves introducing into a combustion chamber of the engine a diesel fuel formulation according to the first aspect or a diesel fuel supplement according to the second aspect. The engine is suitably a compression ignition (preferably diesel) engine. Such a diesel engine may be of the direct injection type, for example of the rotary pump, in-line pump, unit pump, electronic unit injector or common rail type, or of the indirect injection type. It may be a heavy or a light duty diesel engine.

The such aspect of the invention also embraces introducing a triethoxypropane into a reservoir (for example a vehicle fuel tank) which contains a POME-containing diesel fuel formulation, prior to introduction of the resultant mixture into a combustion chamber of the engine. In other words, the diesel fuel formulation of the invention may be prepared in situ in a reservoir from which fuel is fed into an internal combustion engine.

The use of a triethoxypropane, in a diesel fuel formulation containing a POME, may increase the stability of one or more glycerides present in the formulation.

Increasing the stability of a glyceride may involve reducing its tendency, at any given temperature, to crystallise out of the fuel formulation. It may therefore involve increasing the solubility of the glyceride, at any given temperature, in the formulation. It may result in a lowering of the CFPP of the formulation.

At least one of the glycerides may be a monoglyceride, in particular a saturated monoglyceride such as a C16:0 or a C18:0 monoglyceride, more particularly a C16:0 monoglyceride. A "C16:0 monoglyceride" has a carbon chain length of 16 and 0 unsaturated carbon-carbon bonds; similarly a "C18:0 monoglyceride" has a carbon chain length of 18 and 0 unsaturated carbon-carbon bonds. It is believed to be the saturated monoglycerides whose poor, temperature-dependent solubilities in diesel fuels give rise to issues associated with their precipitation. POME contains particularly high levels of C16:0 monoglycerides, compared to other FAMEs such as RME or SME.

The invention may be used to achieve any degree of increase in the stability of the glyceride(s), and/or any degree of increase in the solubility of the glyceride(s) in the formulation. It may be used for the purpose of achieving a target minimum glyceride stability and/or solubility. It may be used to achieve any degree of reduction in the CFPP of the formulation, and/or for the purpose of achieving a target maximum CFPP.

The diesel fuel formulation may contain—in addition to the POME—one or more additional diesel fuel components of the type described above in connection with the first aspect. The formulation may in particular be a winter grade diesel fuel formulation. The triethoxypropane may for instance be used to increase the stability of the one or more glycerides at low temperatures, for instance at −20° C. or below, or at −25° C. or below, or at −30° C. or below.

The use of a triethoxypropane in a POME, may increase the stability of one or more glycerides present in the POME. At least one of the glycerides may be a saturated (in particular C16:0) monoglyceride.

Again, increasing the stability of a glyceride may involve reducing its tendency, at any given temperature, to crystallise out of the POME or the POME/triethoxypropane mixture. It may involve increasing the solubility of the glyceride, at any given temperature, in the POME or the POME/triethoxypropane mixture. It may result in a lowering of the CFPP of the POME. It may thus be used to improve the low temperature storage and/or handling characteristics of the POME, and/or its low temperature performance for instance in a diesel fuel formulation.

The invention may be used to achieve any degree of increase in the stability of the glyceride(s) in the POME, and/or any degree of increase in their solubility, and/or for the purpose of achieving a target minimum glyceride stability and/or solubility in the POME. It may be used to achieve any degree of reduction in the CFPP of the POME, and/or for the purpose of achieving a target maximum CFPP.

The stability of a glyceride in a fuel formulation or FAME may for instance be assessed by measuring the concentration of dissolved glyceride in the formulation or FAME both before and after a predetermined period of storage and/or use. The storage and/or use may take place at a reduced temperature, for example −15 or −20° C. or lower. The greater the reduction in concentration of the dissolved glyceride during the test period, the more of it has crystallised out of the formulation or FAME and hence the lower its stability. An increase in stability will therefore result in a higher concentration of dissolved glyceride after any given time period, and/or in a given minimum concentration of dissolved glyceride being present for a longer period of time.

A suitable method for measuring glyceride concentrations in FAMEs and FAME-containing formulations is EN 14105.

The CFPP of a fuel formulation or FAME may be assessed using a standard test method such as EN 116 or IP 309.

The use of a triethoxypropane, in a diesel fuel formulation containing a POME, may reduce the concentration of a stability-enhancing additive in the formulation. Since a triethoxypropane can improve the stability of POME-containing diesel fuel formulations, it may make possible the use of lower levels of such additives, with consequent savings in processing and cost.

A stability-enhancing additive may be any additive which is able to, or intended to, improve the stability of the formulation, in particular its low temperature stability. A stability-enhancing additive may be a cold flow additive, of the type which is often included in diesel fuel formulations in order to improve their performance, and generally their stability, at lower temperatures. Many such additives are known; they include for example middle distillate flow improvers (MDFIs) and wax anti-settling additives (WASAs) such as ethylene vinyl acetate, poly-olefin esters, polyamides and olefin ester copolymers. Such additives may be included in a diesel fuel formulation so as to improve the low temperature operability of a system (for example a vehicle) running on the formulation. They may be included in order to reduce the amount of filter plugging caused by the formulation during its use in colder climates.

The term "reducing" embraces any degree of reduction, including reduction to zero. The reduction may for instance be 10% or more of the original stability-enhancing additive concentration, or 25 or 50 or 75 or 90% or more. The reduction may be as compared to the concentration of stability-enhancing additive which would otherwise have been incorporated into the fuel formulation in order to achieve the properties and performance required and/or desired of it in the context of its intended use. This may for instance be the concentration of stability-enhancing additive which was present in the formulation prior to the realisation that a triethoxypropane could be used in the way provided by the present invention, and/or which was present in an otherwise analogous fuel formulation intended (eg marketed) for use in an analogous context, prior to adding a triethoxypropane to it in accordance with the invention.

The reduction in stability-enhancing additive concentration may be as compared to the concentration of stability-enhancing additive which would be predicted to be necessary to achieve a desired target level of low temperature stability and/or performance, and/or a desired target CFPP, for the formulation in the absence of the triethoxypropane.

The use of a triethoxypropane, in a POME, may reduce the concentration of a stability-enhancing additive in the POME. Similar comments apply to this aspect of the invention as to the seventh aspect. In particular, the stability-enhancing additive may be a cold flow additive. The invention may be used in order to reduce the concentration of the stability-enhancing additive to zero, ie to remove the need for the additive.

The use of a triethoxypropane, in a diesel fuel formulation containing a POME, may reduce the amount of glyceride (especially monoglyceride) precipitates in the formulation. Thus, as described above, a triethoxypropane may be used to resolubilise—at least partially—glycerides which have already crystallised out of a POME-containing diesel fuel formulation. It may be used to restore, at least partially, the low temperature performance and/or properties of the formulation where they have been compromised by the crystallisation of glyceride impurities present in the formulation.

The use of a triethoxypropane, in a POME, may reduce the amount of glyceride (especially monoglyceride) precipitates in the POME. Again, the triethoxypropane may be used to resolubilise—at least partially—glycerides which have already crystallised out of the POME. It may be used to restore, at least partially, the low temperature performance and/or properties of the POME where they have been compromised by the crystallisation of glyceride impurities present in it.

In the context of the present invention, the "use" of a triethoxypropane in a diesel fuel formulation or in a POME means incorporating the triethoxypropane into the formulation or POME, if appropriate as a blend (ie a physical mixture) with one or more other diesel fuel components such as a diesel base fuel and optionally one or more fuel additives. The triethoxypropane will conveniently be incorporated before the formulation is introduced into an engine or other system which is to be run on the formulation, or before the POME is incorporated into a diesel fuel formulation, or prior to the distribution of, or a period of storage of, the POME or the fuel formulation (particularly in low temperature ("winter") conditions). Instead or in addition the use of a triethoxypropane may involve running a fuel-consuming system, preferably an internal combustion engine, on a diesel fuel formulation containing the triethoxypropane, suitably by introducing the formulation into a combustion chamber of an engine. It may involve running a vehicle which is driven by an internal combustion engine, using a diesel fuel formulation which contains the triethoxypropane. The engine may be be a compression ignition engine such as a diesel engine.

The triethoxypropane may be used in the diesel fuel formulation in the form of a premix containing both the triethoxypropane and a POME. Alternatively, the triethoxypropane may be used in a diesel fuel formulation which already contains a POME.

In the context of the invention, "achieving" a desired target property also embraces—and in an embodiment involves—improving on the relevant target. Thus for instance a triethoxypropane may be used to produce a fuel formulation which has a CFPP below a desired target value, or which exhibits a better cold flow performance or stability than a desired target.

It has also been found that not only can triethoxypropanes improve the cold flow properties of FAMEs (eg by reducing their cloud points, pour points and/or CFPPs), but in the case of a POME they can actually achieve an improvement of greater than conventional theories would have predicted.

For example, the cloud point of a mixture of fuel components (in this context a mixture of a POME and a triethoxypropane) can be predicted from the cloud points of the individual components and their respective volume ratios in the mixture. This theoretical prediction can be made using the Pauillac rule, which provides that the cloud point index CPI for each component of the mixture is given by the equation:

$$CPI=((1.8*CP+491.7)/600)\hat{}(1/0.045)*10^4 \quad \text{[equation 1]}$$

where CP is the measured cloud point of the relevant component.

Having calculated cloud point indices $CPI_n$ for each component n in the mixture, these can be used to calculate the cloud point index $CPI_{blend}$ for the mixture as a whole, on the basis that cloud point indices blend linearly. Thus for a mixture of two components A and B:

$$CPI_{blend}=(\text{volume fraction}_A \times CPI_A)+(\text{volume fraction}_B \times CPI_B) \quad \text{[equation 2]}$$

The CPI value for the mixture can then be used in equation 1 to derive a predicted value for the cloud point of the mixture.

However, it has now been found that the measured cloud point of a mixture of a triethoxypropane with a POME can be significantly lower than these equations predict based on the cloud points of the triethoxypropane and POME individually. This apparent synergy between the triethoxypropanes and POME does not appear to be observed when the ethers are combined with other FAMEs such as RME.

This novel technical effect can be of value in improving the handling characteristics of a POME. The poor low temperature properties of POMEs (typical cloud point 14° C. and CFPP 12° C.) make them difficult to store and to distribute in colder climates. Combining a POME with a triethoxypropane, in accordance with the invention, can help to reduce such difficulties, and hence also the costs associated with the handling of POMEs. In cases, the invention may make it possible to use POMEs in situations where their use is not currently feasible or is commercially or technically unattractive.

The use of a triethoxypropane, at a concentration c, in a POME, may reduce the cloud point of the POME in order to achieve a target maximum cloud point X, wherein X is lower than the cloud point X' which theory would predict to result from adding the triethoxypropane to the POME at concentration c.

The theoretical cloud point, X', may be calculated using the Pauillac blending rule and equations 1 and 2 above.

The actual cloud point achieved by adding the triethoxypropane to the POME (which may equate to the target X) may be at least 1% lower than the theoretical cloud point X', or at least 1.25 or 1.5% lower, or in cases at least 2 or 2.5 or 3% lower. For these purposes, the actual and theoretical cloud points should be expressed in Kelvin.

In another embodiment of the invention provides a method for reducing the cloud point of a POME, in order to achieve a target maximum cloud point X, which method comprises adding to the POME a concentration c of a triethoxypropane, wherein c is lower than the minimum concentration c' of the triethoxypropane which theory would predict needed to be added to the POME in order to achieve the cloud point X. The theoretical triethoxypropane concentration, c', may be calculated using the Pauillac blending rule as above.

The actual triethoxypropane concentration c may be at least 1% v/v lower than the predicted concentration c', or at least 2.5 or 5% v/v lower, or at least 10 or 15% v/v lower, or in cases at least 20 or 25% v/v lower.

The use of a triethoxypropane in a POME, at a concentration c, may reduce the concentration of a cold flow additive in the POME whilst still achieving a target maximum cloud point X, wherein the additive concentration is reduced to a level C, which is below the additive concentration C' which theory would predict needed to be included in order to achieve the cloud point X for the mixture of the POME and the triethoxypropane at concentration c.

The cold flow additive may be any additive which is able to, or intended to, improve the cold flow performance of the POME, for example by lowering its cloud point and/or CFPP. Similar comments apply to this aspect of the invention as to the seventh and eighth aspects.

The term "achieving" a target cloud point X also embraces—and in an embodiment involves—obtaining a cloud point which is lower than X.

It can be seen from the above that there can be a number of advantages to using a triethoxypropane in combination with a POME. The glycerol ether can help to mitigate some of the undesirable properties of the POME, for example its low temperature properties and performance: the ether/POME mixture will have a lower pour point, cloud point and cold filter plugging point than the POME alone. The ether will also help to solubilise the POME, as well as to stabilise the glycerides present in the POME against subsequent recrystallisation. Thus, a premix of a triethoxypropane and a POME can be easier to handle, to distribute and to store, in particular in colder climates, as can a diesel fuel formulation containing both the triethoxypropane and the POME.

A mixture of a triethoxypropane and a POME can also be used to increase the overall biofuel content of a diesel fuel formulation, but with fewer of the negative effects associated with FAMEs (for example, accumulation in engine oils or impairment of low temperature performance). The triethoxypropane will have a lower boiling point than a typical FAME (for example a POME), and can therefore be expected to cause less dilution of engine lubricants.

In an embodiment of the invention, a triethoxypropane may be used as a substitute for some or all of a POME used in a diesel fuel formulation, or as a supplement for the POME. In particular, the present invention can allow the formulation of a diesel fuel containing a proportion of a POME, together with a triethoxypropane, in which the triethoxypropane can compensate at least partially for any change in properties of the formulation due to the presence of the POME.

The use of a triethoxypropane in a diesel fuel formulation may replace, at least partially, a POME which is or would otherwise have been included in the formulation. The triethoxypropane may thus substitute for at least some of the POME which would otherwise have been included in the formulation, for example so as to achieve a desired target specification such as a minimum biofuel content. For instance, a quantity of a triethoxypropane may be included in a diesel fuel formulation in place of the same or a similar quantity of a POME, allowing a target minimum biofuel content to be achieved but without, or with fewer of, the above described drawbacks associated with the use of a POME alone. The triethoxypropane may be included in order to achieve a target minimum biofuel content and at the same time a target maximum cloud point, pour point or CFPP, and/or a target minimum stability, in particular during low temperature storage.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

Where upper and lower limits are quoted for a property, for example for the concentration of a fuel component, then a range of values defined by a combination of any of the upper limits with any of the lower limits is also disclosed herein.

The present invention will now be further described with reference to the following non-limiting examples.

Example 1

Effect of Triethoxypropanes on POME Monoglyceride Stability

The monoglyceride (MG) contents of a POME (ex Shell BV; supplied as EN 14214-compliant) were measured using the standard test method EN 14105:2003. This European standard specifies a method to determine the free glycerol and residual mono-, di- and triglyceride contents in FAMEs intended for addition to mineral oils.

The test method involves transformation of the glycerol and of the mono- and diglycerides into more volatile silylated derivatives in the presence of pyridine and of N-methyl-N-trimethylsilyltrifluoroacetamide (MSTFA). The silylated derivatives are analysed by gas chromatography on a short capillary column with thin film thickness, with an on-column injector or equivalent device, and flame ionisation detection.

The method used was correct to 0.01% w/w. Due to dilution effects, the minimum equivalent (ie neat FAME) MG concentration that can be detected in a fuel blend containing 5% w/w of a FAME is 0.2% w/w.

The saturated MG content of the POME (C16:0+C18:0) was found to be 3330 ppmw (parts per million by weight), representing 45.6% w/w of its total MG content. Its unsaturated MG content (C18:1+C18:2+C18:3) was found to be 2850 ppmw, representing 41.6% w/w of its total MG content. The POME was found to contain significantly higher saturated MG levels than rapeseed methyl ester (RME), soya methyl ester (SME) and tallow methyl ester (TME). Monoglyceride impurities, in particular satured MGs, are therefore a particular problem for POME, as will be the associated risks of glyceride recrystallisation, in particular in colder conditions.

Diesel fuel formulations were prepared by blending the POME with a diesel base fuel DBF, at concentrations of 5 and 10% v/v. The base fuel was a Swedish Class 1 diesel fuel, ex Shell, formulated for use in colder climates (EN 590 Arctic Class 1). Its properties are summarised in Table 1 below.

TABLE 1

| | | | EN590 Arctic Class 1 spec | | |
|---|---|---|---|---|---|
| Parameter | Method | Units | Min | Max | |
| Cetane number | ASTM D613 | — | 49.0 | — | 52.5 |
| Derived cetane number (IQT) 2006 | IP498/06 | — | | | 48.4 |
| Density @ 15° C. | IP 365 | g cm$^{-3}$ | 0.800 | 0.845 | 0.8139 |
| Flash point | IP 34 | ° C. | 55.0 | — | 65.0 |
| IBP | | ° C. | — | — | 176.1 |
| 10% rec | | ° C. | — | — | 197.1 |
| 20% rec | | ° C. | — | — | 204.2 |
| 30% rec | | ° C. | — | — | 212.2 |
| 40% rec | | ° C. | — | — | 220.5 |
| 50% rec | | ° C. | — | — | 230.5 |
| 60% rec | | ° C. | — | — | 239.3 |

TABLE 1-continued

| | | | EN590 Arctic Class 1 spec | | |
|---|---|---|---|---|---|
| Parameter | Method | Units | Min | Max | |
| 70% rec | | ° C. | — | — | 248.9 |
| 80% rec | | ° C. | — | — | 259.9 |
| 90% rec | | ° C. | — | — | 273.6 |
| 95% rec | | ° C. | — | 360 | 284.6 |
| FBP | | ° C. | — | — | 295.8 |
| Residue | | % v/v | — | — | 1.6 |
| Recovery | | % v/v | — | — | 98.1 |
| Loss | | % v/v | — | — | 0.3 |
| Rec @ 240 C. | | % v/v | — | — | 59.9 |
| Rec @ 250 C. | | % v/v | — | 65 | 70.2 |
| Lubricity (HFRR) | ISO 12156 | μm | — | 460 | 638/646 |
| CFPP (average of two measurements) | IP 309 | ° C. | — | −26 | −34.5 |
| Pour point | IP 15 | ° C. | — | | −36 |
| Cloud point (ISL) | IP 219 | ° C. | — | −16 | −33 |
| Viscosity @ 40° C. | IP 71 | mm$^2$ s$^{-1}$ | 1.50 | 4.00 | 1.865 |
| Total acid number | IP 139 | mgKOH/g | | | <0.05 |
| Sulphur - Antek | ISO 20846 | mg/kg | — | — | <3 |
| Fatty acid methyl ester content by FTIR | EN 14078 | % v/v | — | 5 | none |

Further formulations, in accordance with the present invention, were prepared by blending the base fuel with both the POME and a triethoxypropane. Two different triethoxypropanes were tested: 1,2,3-triethoxypropane (ex Chiron AS) and 1,1,3-triethoxypropane (ex Sigma-Aldrich). These formulations contained (a) 2.5% v/v of each of the glycerol ether and the POME and (b) 5% v/v of each.

Aliquots of each of the formulations were taken and analysed for their MG content using EN 14105. The blends were then stored for three weeks at a temperature of −20° C. before again taking aliquots from their supernatants for similar analyses. Any depletion in the level of MGs was taken to indicate their precipitation from solution, the phenomenon which can potentially give rise to filter blockage problems with FAME-containing diesel fuels.

Tables 2 and 3 below summarise the measured MG levels (in % w/w) in the fuel formulations both before and after storage, respectively for those containing 1,2,3-triethoxypropane and 1,1,3-triethoxypropane. Unless otherwise indicated, levels were below the 0.01% w/w (100 ppmw) detection limit. (For this reason the data for the base fuel alone, and for blends containing only the base fuel and a glycerol ether, are not shown because levels were all <0.01% w/w.)

TABLE 2

| (1,2,3-triethoxypropane) | | | | |
|---|---|---|---|---|
| Glycerol ether | | POME conc. (% v/v) | | |
| conc. (% v/v) | Time | 2.5 | 5 | 10 |
| 0 | Week 0 | n/t | C16:0 = 0.01<br>C18:unsat = 0.01 | C16:0 = 0.02<br>C18:unsat = 0.02 |
| | Week 3 | n/t | C18:unsat = 0.01 | C18:unsat = 0.03 |
| 2.5 | Week 0 | C16:0 = 0.01<br>C18:unsat = 0.01 | n/t | n/t |
| | Week 3 | C18:unsat = 0.01 | n/t | n/t |
| 5 | Week 0 | n/t | C16:0 = 0.01<br>C18:unsat = 0.01 | n/t |
| | Week 3 | n/t | C16:0 = 0.01<br>C18:unsat = 0.01 | n/t |

n/t = not tested; blends not prepared or analysed

TABLE 3

| (1,1,3-triethoxypropane) | | | | |
|---|---|---|---|---|
| Glycerol ether | | POME conc. (% v/v) | | |
| conc. (% v/v) | Time | 2.5 | 5 | 10 |
| 0 | Week 0 | n/t | C16:0 = 0.01<br>C18:unsat = 0.01 | C16:0 = 0.02<br>C18:unsat = 0.02 |
| | Week 3 | n/t | C18:unsat = 0.01 | C18:unsat = 0.03 |
| 2.5 | Week 0 | C16:0 = 0.01<br>C18:unsat = 0.01 | n/t | n/t |
| | Week 3 | C18:unsat = 0.01 | n/t | n/t |
| 5 | Week 0 | n/t | C16:0 = 0.01<br>C18:unsat = 0.01 | n/t |
| | Week 3 | n/t | C16:0 = 0.01<br>C18:unsat = 0.01 | n/t |

n/t = not tested; blends not prepared or analysed

The fuel formulations with POME contained detectable levels of saturated MGs (C16:0). Since it is understood to be the saturated MGs whose poor, temperature-dependent solubilities in diesel fuel give rise to issues associated with their precipitation, it is perhaps not surprising that in the formulations containing only POME (ie no glycerol ether), the C16:0 MG levels fell to below the detection limit after the low temperature storage period. It can be assumed that these differences between the pre- and post-storage MG concentrations were due to the precipitation of MG crystals.

The data in Tables 2 and 3 also show, however, that the MG precipitation can be reduced by the inclusion of a triethoxypropane at a concentration comparable to that of the POME. For example, formulations containing 5% v/v POME but no triethoxypropane showed significant reductions in supernatant MG levels after storage, whereas in the corresponding versions containing 5% v/v triethoxypropane, there were no observed reductions in saturated MG levels during storage. These latter formulations, containing both a triethoxypropane and POME in accordance with the invention, would be likely to cause less fuel filter blocking at lower temperatures, to have generally better low temperature stabilities and to provide improved low temperature engine performance.

It is of note that in the formulations containing only 2.5% v/v of the glycerol ethers, saturated MG levels still fell to below the detection limit over the test period. This suggests that there may be a minimum concentration of the glycerol ether (for example 3% v/v) below which the stabilisation effect of the ether is less pronounced.

This example demonstrates that a triethoxypropane can reduce the amount of MG precipitation from a POME-containing diesel fuel formulation, leaving the post-storage MG levels much closer to those before storage. The ether appears to stabilise the MGs present in the POME. The present invention can therefore allow the formulation of a diesel fuel which contains a reasonable concentration of biofuel components, and yet which has better low temperature properties than would have been possible by incorporating a FAME alone at the same or even a lower concentration. Using the glycerol ether and the POME together in a diesel fuel formulation makes it easier to tailor the formulation to fit with relevant standards or to meet desired specification targets, in particular for winter grade fuels which face more stringent specifications than summer grade fuels.

Example 2

Effect of Triethoxypropanes on Low Temperature Properties of POME

Cloud point (CP) and CFPP measurements were made on the POME and the two triethoxypropanes used in Example 1, as well as on 50:50 volume POME/ether mixtures. Similar measurements were made on an RME (ex ADM; supplied as EN 14214-compliant), and on 50:50 volume mixtures of the RME with the same triethoxypropanes.

The results are shown in Table 4 below.

TABLE 4

| Glycerol ether | No FAME | RME | POME |
|---|---|---|---|
| Cloud point—ASTM D5773 (° C.) | | | |
| No ether | | −4.0 | 19.2 |
| 1,1,3 triethoxypropane | <−71* | −12.1 | 2.2 |
| 1,2,3 triethoxypropane | −22.0 | −11.4 | 2.4 |
| CFPP—IP 309 (° C.) | | | |
| No ether | | −16.0 | 12.5 |
| 1,1,3 triethoxypropane | <−51* | −28.5 | 2.0 |
| 1,2,3 triethoxypropane | −41.0 | −27.7 | 2.0 |

*absolute values could not be determined since they were below lower limits of test method It can be seen from Table 4 that both of the triethoxypropanes lower the cloud points and CFPPs of the FAMEs with which they are blended. This in turn will improve the low temperature handling properties of the FAMEs.

Cloud points do not blend linearly in mixtures of fuel components, and thus the value for a 50:50 mixture of FAME and glycerol ether could not simply be predicted as the midpoint of the measured values for the two components. However, the cloud point of such a mixture could be predicted using the Pauillac rule described above, based on the measured cloud points of the individual components.

Using the measured CP data for the individual components and equation 1 above, cloud point indices (CPIs) were calculated for each of the components. These were then used in equation 2 to derive a calculated CPI for each of the 50:50 FAME/triethoxypropane mixtures. These values were then converted into "predicted" cloud points for the mixtures, using equation 1. The predicted values are shown in Table 5 below, along with the measured cloud points. In the table, "1,1,3" denotes 1,1,3-triethoxypropane, and "1,2,3" denotes 1,2,3-triethoxypropane.

TABLE 5

| Parameter | RME | 1, 1, 3 | 1, 2, 3 | POME | 1, 1, 3 | 1, 2, 3 |
|---|---|---|---|---|---|---|
| Measured CP (° C.) | −4.0 | −71.0 | −22.0 | 19.2 | −71.0 | −22.0 |
| → CPI (equation 1) | 86.4 | 0.15 | 18.6 | 542.5 | 0.15 | 18.6 |

| Parameter | RME | RME + 1, 1, 3 | RME + 1, 2, 3 | POME | POME + 1, 1, 3 | POME + 1, 2, 3 |
|---|---|---|---|---|---|---|
| → $CPI_{blend}$ (equation 2) | n/a | 43.3 | 52.5 | n/a | 271.3 | 280.5 |
| → predicted CP (° C.) (equation 1) | n/a | −12.2 | −10.0 | n/a | 10.2 | 10.7 |
| Measured CP (° C.) | n/a | −12.1 | −11.4 | n/a | 2.2 | 2.4 |

The predicted CPs for the RME/triethoxypropane blends show good agreement with the measured values. However, the measured CPs for the POME/ether blends were significantly lower than the values derived theoretically. Thus, there appears to be an unexpected synergy between the triethoxypropanes and the POME, which leads to the ethers having a greater effect on POME cold flow properties than the theory would have predicted.

In accordance with the present invention, therefore, a triethoxypropane may be used to improve the cold flow properties of a POME, and in turn to facilitate its handling. The fact that the improvement obtained surpasses that which would have been expected can make the triethoxypropane an efficient and attractive POME additive, which is likely to have particular value in colder (for example arctic) climates where at present heated lines may be needed for transporting and handling the neat POME. The invention may even make feasible the use of POME in climates where it is not currently used because of its poor low temperature properties.

We claim:

1. A diesel fuel formulation comprising (i) a triethoxypropane in a concentration of 1% v/v or greater (ii) a palm oil methyl ester (POME) in a concentration in a range of 0.5% v/v to 15% v/v; (iii) at least one diesel fuel component in a concentration of 70% v/v or greater; and (iv) a monoglyceride.

2. The diesel fuel formulation of claim 1 wherein the triethoxypropane is selected from 1,2,3-triethoxypropane; 1,1,3-triethoxypropane; and mixtures thereof.

3. The diesel fuel formulation of claim 2 wherein the triethoxypropane is 1,1,3-triethoxypropane.

4. The diesel fuel formulation of claim 1 wherein the volume ratio of the triethoxypropane to the POME is in the range of from 2:1 to 1:2.

5. A process for the preparation of a diesel fuel formulation comprising blending together (i) a triethoxypropane in a concentration of 1% v/v or greater, (ii) a POME in a concentration in a range of 0.5% v/v to 15% v/v, (iii) at least one diesel fuel component in a concentration of 70% v/v or greater; and (iv) a monoglyceride.

6. The process of claim 5 wherein the triethoxypropane comprises 1,1,3-triethoxypropane produced by converting glycerol to acrolein and then reacting the acrolein with ethanol.

7. The process of claim 6 wherein the glycerol is a product of the transesterification of an oil to produce a fatty acid alkyl ester (FAAE).

8. The process of claim 6 wherein the ethanol is biologically derived.

9. A method of operating an internal combustion engine, and/or a vehicle which is driven by an internal combustion engine comprising introducing into a combustion chamber of the engine a diesel fuel formulation of claim 1.

10. A method of operating an internal combustion engine, and/or a vehicle which is driven by an internal combustion engine comprising introducing into a combustion chamber of the engine a diesel fuel formulation of claim 4.

11. The formulation of claim 1 wherein the monoglyceride comprises a saturated monoglyceride.

* * * * *